United States Patent [19]

Agee, Sr.

[11] Patent Number: 4,756,445

[45] Date of Patent: Jul. 12, 1988

[54] PROTECTIVE LINER FOR METAL REFUSE RECEPTACLE

[76] Inventor: Richard J. Agee, Sr., P.O. Box 239, Hot Springs, S. Dak. 57747

[21] Appl. No.: 129,054

[22] Filed: Dec. 7, 1987

[51] Int. Cl.[4] ..... B65D 90/04

[52] U.S. Cl. ..... 220/410; 220/408; 220/404

[58] Field of Search ..... 220/410, 400, 404, 412, 220/413

[56] References Cited

U.S. PATENT DOCUMENTS

| | | | |
|---|---|---|---|
| Re. 25,618 | 7/1964 | Goodman | 220/408 |
| 649,800 | 5/1900 | Bollard | 220/408 |
| 696,832 | 4/1902 | Maschke . | |
| 1,080,470 | 12/1913 | Nutter et al. | 220/408 |
| 1,123,793 | 1/1915 | Pick | 220/410 |
| 1,174,136 | 3/1916 | Filger . | |
| 1,709,510 | 4/1929 | White | 220/408 |
| 1,763,907 | 6/1930 | Sommers . | |
| 2,238,830 | 4/1941 | Smith | 220/7 |
| 2,490,790 | 12/1949 | Emerson | 220/1 |
| 3,057,506 | 10/1962 | Wetlesen | 220/17 |
| 3,074,583 | 1/1963 | Martinich, Jr. | 220/1 |
| 3,155,304 | 11/1964 | Beerend | 220/410 |
| 3,602,386 | 8/1971 | Brime | 220/410 |
| 4,111,481 | 9/1978 | Nix et al. | 296/39 |
| 4,122,973 | 10/1978 | Ahern | 220/404 |
| 4,335,074 | 6/1982 | Bernas | 220/410 |
| 4,340,138 | 7/1982 | Bernhardt | 220/410 |
| 4,521,116 | 6/1985 | Adsit | 366/54 |

*Primary Examiner*—Joseph Man-Fu Moy

*Attorney, Agent, or Firm*—Dorr, Carson, Sloan & Peterson

[57] ABSTRACT

Maintenance and replacement costs for metal refuse receptacles, i.e. "dumpsters", are reduced by a protective liner comprising a single-piece molded plastic container with a lip substantially conforming to the rim of the metal refuse receptacle, which is constructed of a plastic that is non-corrosive, non-rusting, and impact and fire-resistant, and which is attached to the metal refuse receptacle by engaging means that attach the liner lip to the receptacle rim.

4 Claims, 3 Drawing Sheets

PROTECTIVE LINER FOR METAL REFUSE RECEPTACLE

BACKGROUND OF THE INVENTION

1. Field of Invention

This invention relates to liners for garbage containers. More particularly, the invention applies to liners which are constructed of molded plastic and are attached to a metal refuse receptacle so as to provide an inexpensive yet durable means to protect the metal refuse receptacle from rust, corrosion, and other damage.

2. Discussion of Prior Art

Liners of various types are well known in the prior art. Prior to the application for this invention, a patentability search uncovered the following patents:

U.S. Pat. No. 696,832 to S. Maschke, 4-1-02
U.S. Pat. No. 1,174,136 to M. L. Filger, 3-7-16
U.S. Pat. No. 1,763,907 to B. Sommers, 6-17-30
U.S. Pat. No. 2,238,830 to C. W. Smith, 4-15-41
U.S. Pat. No. 2,490,790 to W. Emerson, 12-13-49
U.S. Pat. No. 3,057,506 to R. B. Wetlesen, 10-9-62
U.S. Pat. No. 3,074,583 to Martinich, Jr., 1-22-63
U.S. Pat. No. 4,111,481 to Nix et al, 9-5-78
U.S. Pat. No. 4,122,973 to Ahern, 10-31-78
U.S. Pat. No. 4,521,116 to Adsit, 6-4-85

Liners known in the field of refuse storage and disposal have generally been provided for convenience. Both reusable and disposable liners have been designed for home use, or use on a small scale. These liners have addressed the problems of odor and ease of disposal in several different ways. For example, to control odor, in the Filger patent (U.S. Pat. No. 1,174,136) the inner container of a kitchen or hotel-type pantry refuse container is deodorized. The Sommers patent (U.S. Pat. No. 1,763,907) provides disposable paper liners which have been impregnated with a deodorizing disinfectant. The cooperating lid of the Sommers apparatus further reduces refuse odor, and the fact that the liners are disposable eliminates the necessity of frequent cleaning as a means to control odor. The apparatus of the Martinich patent (U.S. Pat. No. 3,074,583) addresses odor by providing drainage and ventilation. Separation of the liner from the garbage container provides a convenient method of transporting refuse for disposal. Such is the object of the Smith patent (U.S. Pat. No. 2,238,830) and Maschke patent (U.S. Pat. No. 696,832). The liners disclosed in these patents address convenience, and balance the increased cost of the liner against the goals of odor-control and ease of disposal.

In the arena of public use, garbage receptacles with liners have been designed primarily with security and advertising in mind. The Emerson patent (U.S. Pat. No. 2,490,790), for example, discloses a sturdy framework designed to hold a container for refuse and exterior panels which can be used for advertising. In the Wetlesen patent (U.S. Pat. No. 3,057,506) an outer container on which advertising can be placed holds an inner basket. The two containers are padlocked together to prevent vandalism. These refuse containers and their associated liners, like those designed for home use, are appropriate for use on a small scale where factors of economics and durability are but two of many important considerations.

Liners have also been known in other fields, being used for both convenience and for protection. Vaccum-formed liners, such as that disclosed by the Ahern patent (U.S. Pat. No. 4,122,973) have been disclosed for single-use applications in paint buckets and the like. The relatively benign nature of paint has permitted such liners to be relatively thin, support being provided by a few longitudinal ribs along the side walls and by a thickening of the upper rim which overhangs the rim of the outer container. Rotational movement of the liner within the bucket is prevented by interlocking indentations on the rims. The Adsit patent (U.S. Pat. No. 4,521,116) shows the use of a liner in conjunction with a drum, suitable for mixing materials such as concrete. The smaller inner container has inwardly extending agitating means and a lip on which can be snapped a lid. This inner container is attached to the rotating means of the outer drum and rotated within that drum to mix the contents. Finally, a truck bed liner is taught by the Nix et al. patent (U.S. Pat. No. 4,111,481). This is a molded plastic liner in two parts, a liner for the bed itself fastened by means of toggle bolts and a snapon liner for the tail gate of the truck. Both liner components are ribbed for ventilation between the liner and the truck bed.

Metal refuse receptacles commonly referred to as "dumpsters", such as are found in residential alleys, and behind business and apartment buildings, are typically of a volume of about two yards and are fitted for mechanical emptying by a trash compacting truck. The construction requirements imposed on these containers by virtue of their location and use make them relatively expensive. To withstand the rough handling of the mechanical emptying process, the containers must not only be of very durable material but also must be precisely fitted to the lifting means of the truck. The weight of the container, especially when filled with refuse, necessitates that it be equipped with wheels. At the same time, this refuse receptacle is subjected to considerable abuse by the weather and the refuse it contains. Presently, such containers require periodic refurbishing, including cleaning and painting to remove refuse and rust from the inside of the container. In some cases the damage to the container is such that cleaning and repainting is insufficient and repair and/or replacement of metal is required. In the worst case, the entire receptacle must be replaced at a cost which includes not only the labor and materials of initial construction but also the labor and materials required for maintenance during the life of the receptacle.

SUMMARY OF THE INVENTION

An object of the present invention is to provide a liner which will protect a metal refuse receptacle from the abuses of the weather and the refuse it contains, and thereby reduce the frequency of replacement of the metal refuse receptacle and reduce the cost of maintaining the refuse receptacle during its life.

The liner according to the present invention is made of a durable and economical plastic material. This plastic is non-corrosive, non-rusting, and fire resistant. The liner is constructed by a single-piece molding process and is of sufficient thickness to resist the impact of refuse thrown into the receptacle, yet remains flexible enough to withstand the stress placed on the metal receptacle during the mechanical emptying process. The liner lip, which coincides with the rim of the refuse receptacle, serves to prevent moisture from entering the space between the liner and the receptacle.

This impervious liner fits snugly into the metal refuse receptacle and is attached to the receptacle at the rim by means of bolts or other appropriate fastening means. It does not obstruct the emptying of the refuse receptacle. The construction of the lip is such that the liner is securely fastened to the receptacle and remains stable during mechanical emptying.

A single-piece molded construction from plastic creates a lightweight liner which adds very little extra weight to the receptacle and which, by virtue of having a smooth interior surface, facilitates the removal of refuse, thereby contributing to proper sanitation. The lightness and means of attachment of the liner make it easy both to install and remove from the refuse receptacle.

Accordingly, the present invention provides a durable and economical liner for a refuse receptacle. Because the cost of the liner compares favorably to the cost of labor and materials involved in maintenance of the metal refuse receptacle, and because the liner is readily detachable from the receptacle, it can be periodically replaced. The liner is, however, sufficiently durable to withstand use over an extended period of time. Thus, the liner may greatly extend the life of the metal refuse receptacle and reduce the overall costs of providing refuse removal service.

DESCRIPTION OF THE DRAWING

The present invention will be discussed in detail with reference to the accompanying drawings in which.

DESCRIPTION OF THE INVENTION

Figure 1:
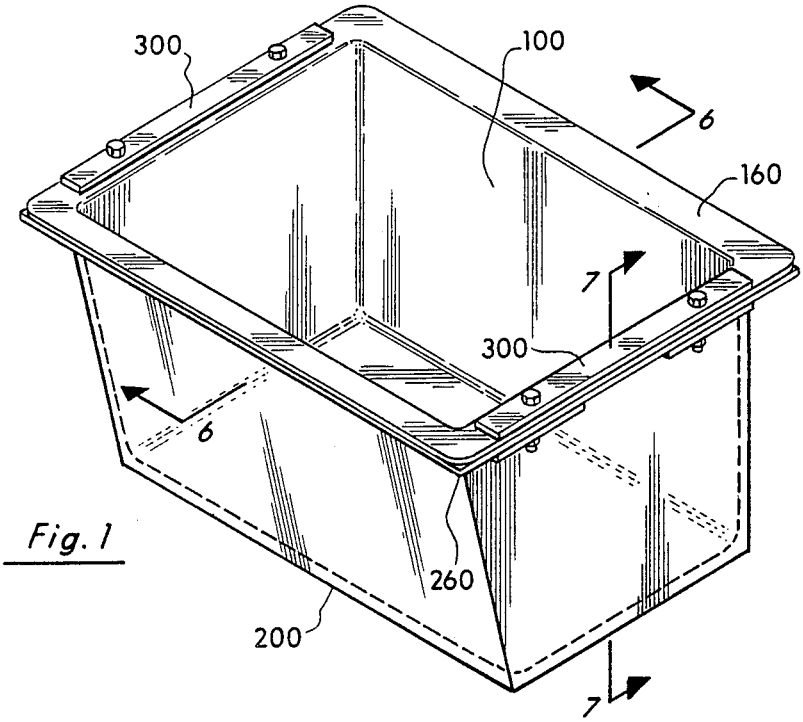
FIG. 1 is a perspective view of the use of the disposable refuse receptacle liner in conjunction with a metal refuse receptacle according to the teachings of the present invention.

The general concept of the operation of this invention is illustrated in FIG. 1. The disposable refuse receptacle liner 100 fits snugly into the refuse receptacle 200 to afford a means of protecting the refuse receptacle from rust, corrosion and other damage. Illustrated here in these drawings is a standard two yard refuse receptacle, often called a "dumpster", and a liner suitable for use with such a "dumpster." A flat, substantially horizontal, narrow ledge forms a rim 260 which encircles the periphery of the top of the receptacle 200. In the same manner, a flat, substantially horizontal lip 160 encircles the periphery of the top of the liner 100 and substantially conforms to the width and angle of the receptacle rim 260. This lip 160 serves to keep moisture or other material from collecting between the receptacle 200 and liner 100. The liner is firmly anchored to the receptacle by attachment means 300, which, in this preferred embodiment, are located in an opposing configuration to lend stability to the attachment.

Figure 2:
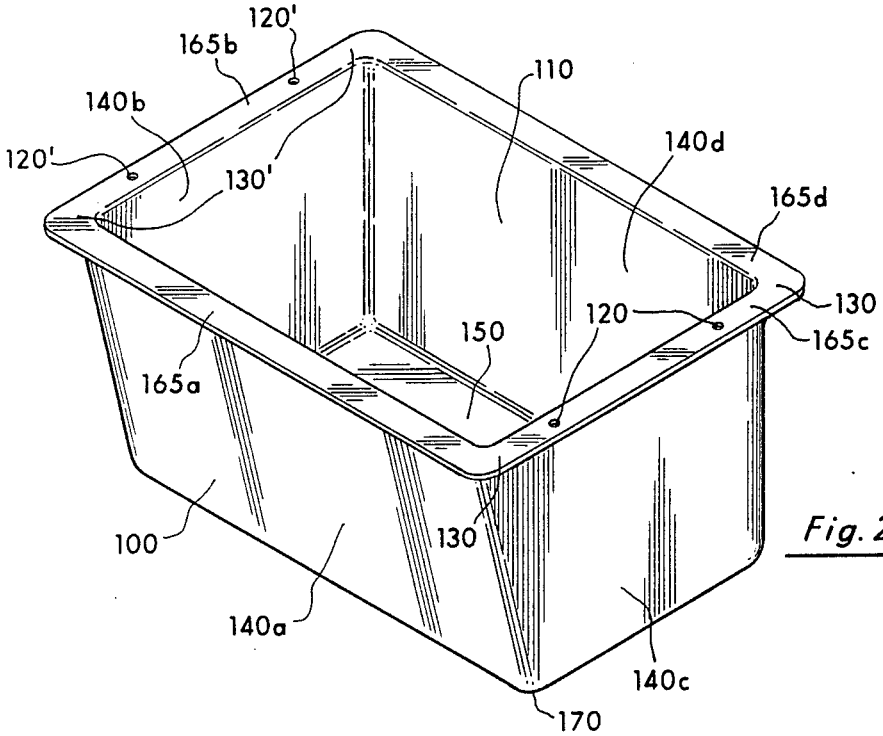
FIG. 2 represents the disposable refuse receptacle liner in a perspective view.

The liner 100, as illustrated in FIG. 2, is essentially an open container. The liner 100 has a substantially rectangular closed floor 150, three substantially vertical walls **140*b*, 140*c*, and 140*d*, a fourth front wall 140*a* which angles slightly outwardly from the floor 150, and a top opening 110. Because of the outward angle of the front wall 140*a*, the area of the top opening 110 is slightly larger than the area of the closed floor 150. The front wall 140*a* and vertical walls 140*b*, 140*c*, and 140*d* terminate in lip segments 165*a*, 165*b*, 165*c*, and 165*d*, respectively. The longitudinal ends of the lip segments 165*a*, 165*b*, 165*c*, and 165*d* are contiguous and together form the lip 160 at the top of the liner 100. In this perspective view of a preferred embodiment, a first plurality of formed holes 120 is shown on the longitudinal ends 130 of the lip segment 165*c* at the terminal edge of vertical wall 140i c. Another such plurality of formed holes 120' is located on the opposite vertical wall 140*b* near the longitudinal ends 130' of lip segment 165*b*. It is through these pluralities of formed holes 120 and 120' that the attachment means 300 secure the liner 100 to the refuse receptacle 200. It is acknowledged that in other equally effective embodiments of the present invention these pluralities of formed holes 120 and 120' could be comprised of a greater number of formed holes or could be differently located and still accomplish the secure attachment of the liner 100 to the receptacle 200. Rounded corners 170 at the junctions between the front and vertical walls 140*a*, 140*b*, 140*c*, and 140*d*, and around the periphery of the closed floor 150, contribute to easy insertion of the liner 100 into the receptacle 200, and to the thoroughness with which the liner 100** can be emptied.

The preferred material for construction of the liner 100 is a plastic. Because the nature of the refuse with which the liner will come into contact is unpredictable, a suitable plastic is one which is non-corrosive, non-rusting, fire resistant, semi-rigid, and impact resistant. The group of plastics having these characteristics includes, but is not limited to, polyurethane and fiberglass. The thickness of the liner 100 necessary to construct a durable and lightweight container at an economical cost will depend on the choice of a particular plastic.

The use of plastic is advantageous because it enables one-piece molded construction of the liner 100. This construction method readily lends itself to the formation of a liner 100 which is easily emptied. Rounded corners 170 are easily formed by the molding process. Also, the molding process can produce a smooth surface on the inner surface of the liner 100 from which refuse is easily removed. Because a central object of the present invention is the protection of a relatively expensive metal refuse receptacle which is susceptible to rusting, corrosion and other damage, it is important that the liner herein disclosed be as durable as possible while being at the same time sufficiently inexpensive so as to be able to be disposed of and replaced whenever necessary. Plastic best serves this objective.

Figure 3:
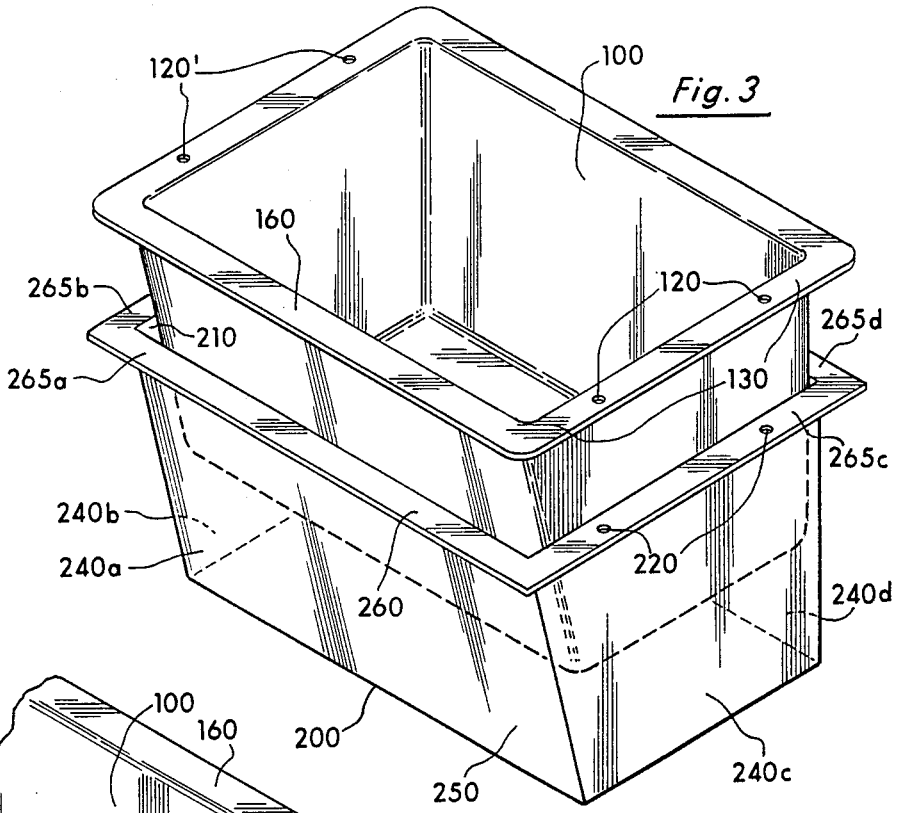
FIG. 3 provides a perspective view of the disposable refuse receptacle liner in association with a refuse receptacle and illustrates the detail of the refuse receptacle.

As shown in FIG. 3, the shape and size of the liner 100 essentially conforms to the shape and size of the refuse receptacle 200. The dimensions of the two yard "dumpster" shown here are as follows: length 77½ inches, depth 68 inches, and height 47 inches. The dimensions of the liner 100 are such as to permit easy insertion into the receptacle 200 and at the same time to minimize the gap between the liner 100 and receptacle 200 in an effort to prevent water from collecting between the two. The preferred clearance between the liner and the receptacle is approximately ¼". This ¼" clearance can be used as a guideline for the construction of liners according to the teachings of the present invention which are appropriate for use with other standard and non-standard refuse receptacles. It is to be expressly understood that while ¼" is preferred other suitable dimensions could be used.

Like the liner 100, the receptacle has an open top 210, a substantially rectangular closed bottom 250, three substantially vertical sides 240*b*, 240*c*, and 240*d*, and a fourth front side 240*a* which angles slightly outwardly so that the area of the open top 210 is somewhat greater than the area of the closed bottom 250. The vertical sides 240*b*, 240*c*, and 240*d* and the front side 240*a* are joined to each other at essentially perpendicular angles (see 270*b*, FIGS. 6 and 7). The vertical sides 240*b*, 240*c*, and 240*d* are also affixed to the closed bottom 250 at perpendicular angles. A slightly obtuse angle (see 280, FIG. 6) of the juncture of the front wall 240*a* with the closed bottom 250 creates the outward angle of the front wall 240*a*. At the top of each of the front and vertical walls 240*a*, 240*b*, 240*c*, and 240*d* of the receptacle are four rim section 265*a*, 265*b*, 265, and 265*d* respectively. These rim sections 265*a*, 265*b*, 265*c* and 265*d* are contiguous and form the rim 260 of the receptacle. In the preferred embodiment here illustrated, a second plurality of formed holes 220 is shown in rim section 265*c*. Another such plurality of holes 220' is located on the opposite vertical side 240*b* in its rim section 265*b*. These second pluralities of formed holes 220 and 220' coincide with the first pluralities of formed holes 120 and 120' on the longitudinal ends 130 and 130' of the lip segments 165*c* and 165*b*. This illustrative embodiment reflects a desirable configuration of holes for attachment of the liner 100 to the receptacle 200. As previously stated however, the number of formed holes and their location could vary; the variation in the number and location of formed holes is limited only by the necessity that the holes in the rim 260 coincide with those in the lip 160 and be in such a location as to afford secure attachment of the liner 100 to the receptacle 200. For example, more than the two holes here shown might be used to accommodate the use of more than one attachment means 300 on one or more of the lip segments 165*a*, 165*b*, 165*c*, and 165*d*. Also, attachment means 300 could be mounted on as many as four of the lip segments 165*a*, 165*b*, 165*c*, and 165*d*.

Figure 4:
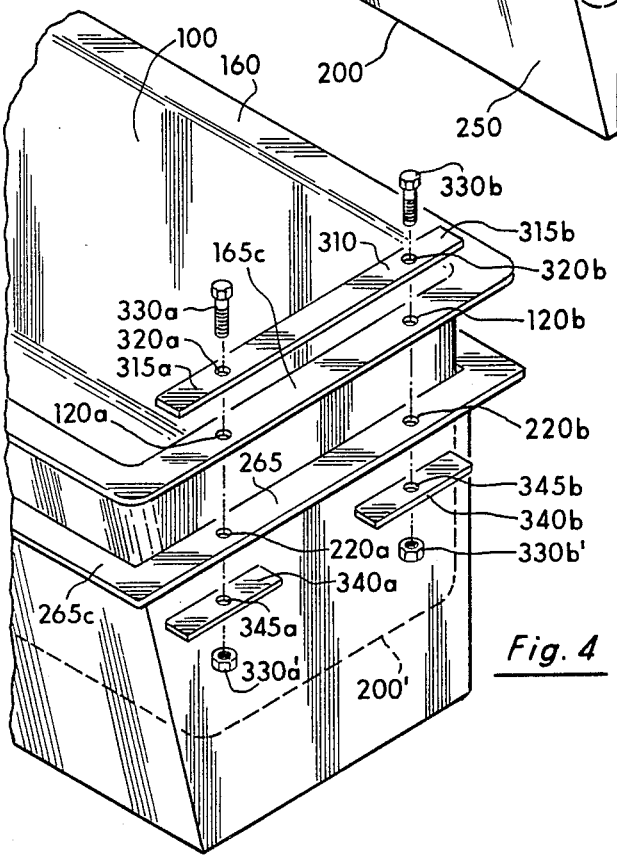
FIG. 4 shows the detail of the attachment means of the present invention.

The liner lip 160 and receptacle rim 260 are held together by attachment means 300, the parts of which are illustrated in FIG. 4. A rigid and strong strip 310 with, in this preferred embodiment, at least two holes 320*a* and 320*b* in its longitudinal ends 315*a* and 315*b*, is placed along the upper surface 168 of the lip segment 165*c*. The strip 310 is of approximately the same width as the lip segment 165*c* and slightly shorter. The formed holes 320*a* and 320*b* in the strip coincide with the formed holes 120*a* and 120*b* in the lip segment 165*c*. Below the receptacle rim section 265*c* are placed two support strips 340*a* and 340*b* which are approximately the same width as the lip segment 165*c* and the rim segment 265*c*, and are less than half as long as the strip 310. Each of these support strips 340*a* and 340*b* has a central hole 345*a* and 345*b* respectively. Engaging means 330*a* is successively guided through the coinciding formed hole 320*a* in the first strip 310, the formed hole 120*a* in the lip segment 165*c*, the formed hole 220*a* in the rim section 265*c*, and the central formed hole 345*a* in the support strip 340*a*. A second engaging means 330*b* is successively guided in the same manner through the coinciding second formed hole 320*b* in the first strip 310, the second formed hole 120*b* in the lip segment 165*c*, the second formed hole 220*b* in the rim section 265*c*, and the central formed hole 345*b* in the second support strip 340*b*. The engaging means 330*a* and 330*b* could be any one of numerous sorts of fasteners including, but not limited to, bolts, pins, rivets, wire, or clamps.

In the preferred embodiment as illustrated, the bolts 330*a* and 330*b* utilize nuts 330*a'* and 330*b'* below the support strips 340*a* and 340*b* to securely fasten the liner 100 to the receptacle 200. The first strip 310 and the support strips 340*a* and 340*b* could be made of any rigid and strong material, for example, metal or plastic. It should also be noted that, although in this illustration of a preferred embodiment only one attachment means 300 is shown and that attachment means 300 utilizes a single first strip 310 in association with only two support strips 340*a* and 340*b*, the goal of secure attachment of the liner 100 to the receptacle 200 could also be achieved by using more than one attachment means 300 on one of the lip segments 165*a*, 165*b*, 165*c* and 165*d*. Furthermore, the first strip 310 could be associated with more than two support strips 340, the number of support strips 340 being limited only by the existence of coincidental holes through the first strip 310, the lip segment 165, and the rim segment 265, and by the length of the first strip 310. Location of the formed holes 320*a* and 320*b* at longitudinal ends 315*a* and 315*b* of the first strip 310 is the preferred embodiment, however, depending on the size of the receptacle 200 and the weight of the liner 100 secure attachment could be afforded by numerous other configurations.

Figure 5:
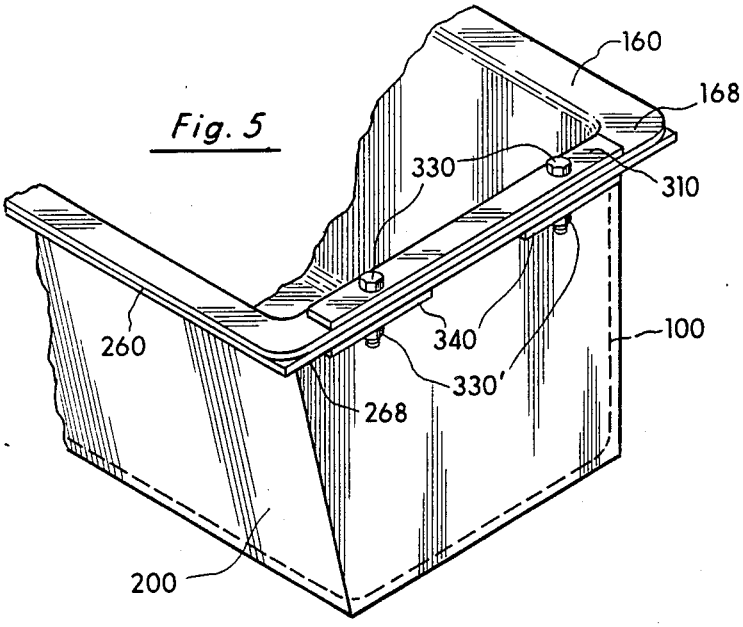
FIG. 5 illustrates in a partial, perspective view the disposable refuse receptacle liner secured to the refuse receptacle by attachment means.

The fully installed attachment means 300 is illustrated in FIG. 5. As shown, the attachment means 300 brings the lip 160 and rim 260 into flush contact. The first strip 310 rests on the upper surface 168 of the liner lip 160 and the support strips 340 are brought up against the undersurface 268 of the receptacle rim 260 by the engaging means 330 and 330'. The simplicity and accessibility of the attachment means 300 makes it easy both to install and remove the liner 100. The size, shape, and configuration of the attachment means 300 is such that it need not obstruct the use of the receptacle 200. Engaging means 300 such as flat or recessed bolts may be used so that a lid can be installed flush with the first strip 310. The attachment means 300 is located so that emptying of the receptacle 200 is not hindered.

Figure 6:
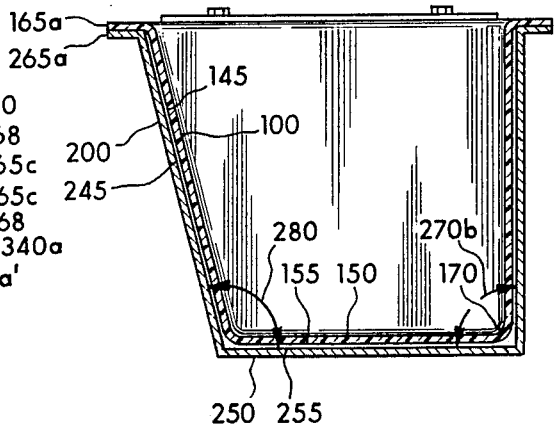
FIG. 6 is a cross-sectional view of the disposable refuse receptacle liner installed in the refuse receptacle, taken along section line 6—6 in FIG. 1.
Figure 7:
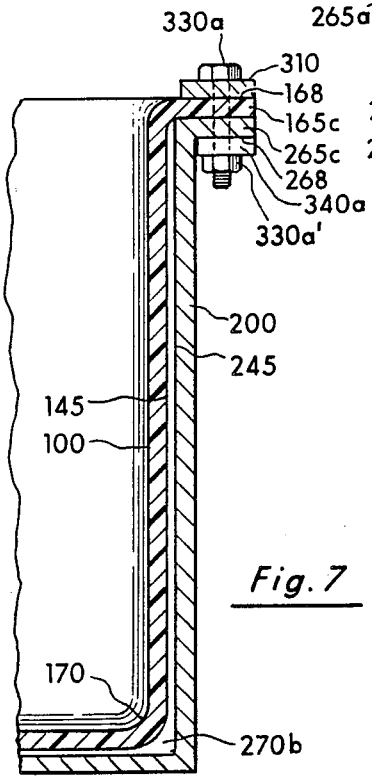
FIG. 7 is a cross-sectional view of the attachment means securing the disposable refuse receptacle liner to the refuse receptacle, taken along section line 7 of FIG. 1.

Once installed, the liner 100 resides in a snug relationship with the receptacle 200 as illustrated by cross-sections in FIGS. 6 and 7. The outer surface 145 of the liner walls 140*a*, 140*b*, 140*c*, and 140*d* is flush with the inner surface 245 of the receptacle sides 240*a*, 240*b*, 240*c* and 240*d*. Also, the undersurface 155 of the liner floor 150 is flush with the upper surface 255 of the receptacle bottom 250. There is a peripheral gap around the juxtaposition of the liner floor 150 and the receptacle bottom 250 formed at the perpendicular angles 270*b* and the obtuse angle 280 between the vertical and front sides 240*a*, 240*b*, 240*c*, and 240*d*, and the bottom 250 of the receptacle 200. This peripheral gap arises because of the rounded corners 170 of the liner. The intimate relationship of the liner 100 and receptacle 200, particularly in the region of the rim segments 265 and lip segments 165, inhibits moisture collection between the two containers.

The cross section perpendicular to that illustrated in FIG. 6 which is shown in FIG. 7 illustrates the detail of the attachment means in its secured position. The essential condition for effective attachment of the liner 100 to the receptacle 200 is the alignment of formed holes in the first strip 310, the lip segment 165*c*, the rim section 265*c*, and the support strip 340*a*. A fastener such as the bolt 330*a* here illustrated, when passed through the aligned holes, holds the first strip 310 against the upper surface 168 of the lip segment 165*c* and brings the support strip 340*a* into contact with the lower surface 268 of the rim segment 265*c* by means of a nut 330*a'*. The attachment means 300 thereby anchors the liner 100 to the receptacle 200 bringing the outer surface 145 of the liner 100 flush against the inner surface 245 of the receptacle 200, leaving only the gap around the periphery of the receptacle bottom between the rounded corners 170 of the liner and the perpendicular and obtuse angles 270*b* and 280 between the sides 240*a*, 240*b*, 240*c* and 240*d* and bottom 250 of the receptacle.

While preferred embodiments of the present invention have been shown, it is to be expressly understood that modifications and changes may be made thereto and that the present invention is set forth in the following claims.

I claim:

1. A liner for a metal refuse receptacle, said receptacle having an open top and a substantially rectangular closed bottom, said receptacle further having three substantially vertical sides and a fourth front side angling outwardly so that the area of said open top is greater than the area of said closed bottom, said vertical and front sides being affixed to each other at substantially perpendicular angles, said three vertical sides being affixed to said bottom at substantially perpendicular angles and said fourth front side being affixed to said bottom at a slightly obtuse angle, each of said sides terminating at said open top in an outwardly extending rim section, each said rim section being a flat, substantially horizontal, narrow member, said rim sections forming an upper rim to said refuse receptacle which encircles the periphery of said open top, said liner comprising:

a top opening and a substantially rectangular closed floor, three substantially vertical walls and a fourth front wall angling outwardly so that the area of said top opening is greater than the area of said closed floor, said vertical and front walls being integrally joined to each other and to said floor at rounded corners, the dimensions of said floor and said vertical and front walls substantially corresponding to the internal shape and size of said receptacle;

outwardly extending terminal lip segments formed at the top of said vertical and front walls, each of said lip segments being a flat, substantially horizontal member having a width approximately equal to the width of said rim sections, the totality of said lip segments forming a lip constructed to substantially conform to said upper rim of said receptacle, two or more of said lip segments having a first plurality of formed holes, said first plurality of formed holes in said lip segment coinciding with a second plurality of formed holes located in one of two or more of said rim sections, said first plurality of formed holes being located near the opposite longitudinal ends of said lip segment, the first two of said lip segments having formed holes being on two of said walls which are in an opposing configuration; and two or more attachment means associated with said lip, each of the first two of said attachment means being located on one of two lip segments having a first plurality of holes, said two lip segments being on two of said walls which are in an opposing configuration, said attachment means utilizing said first plurality of holes to securely and removable attach said liner to said receptacle, said liner when attached to said receptacle having the under surface of said closed floor abutting the upper surface of said receptacle bottom and having the outer surface of said vertical and front walls abutting the inner surfaces of said vertical and front sides of said receptacle.

2. A liner as in claim 1 wherein said vertical and front walls, said floor, and said lip are constructed as a single piece of molded plastic, said plastic being non-corrosive, non-rusting, semi-rigid, impact and fire resistant, and smooth textured.

3. A liner as in claim 2 wherein said plastic is selected from the group consisting of polyurethane and fiberglass.

4. A liner as in claim 1 wherein each of said attachment means comprises:

a first strip associated with one of said lip segments having a first plurality of formed holes, said first strip being of substantially the same width as said lip segment and of a length less than that of said lip segment, said first strip having at least two formed attachment holes, the first two of said formed attachment holes being located near opposite longitudinal ends of said first strip, said formed attachment holes coinciding with said first plurality of formed holes in said lip segment, said first strip being aligned in a flat, resting position along the upper surface of said lip segment;

two or more support strips of substantially the same width as said lip segment and less than half of said length of said first strip, said support strips each having a central formed hole;

two or more engaging means, a first engaging means being inserted through one of said formed attachment holes in said longitudinal end of said first strip, then through one of said first plurality of formed holes in said lip segment and through the corresponding formed hole of said second plurality of formed holes in said rim section, and then through said central formed hole in the first of said support strips for firmly, but removable, holding said liner to said receptacle, and a second engaging means inserted through said formed hole in said opposite longitudinal end of said first strip, then through the coinciding formed hole of said first plurality of formed holes in said lip segment and then through the corresponding formed hole of said second plurality of formed holes in said rim section, and then through said central formed hole in the second of said support strips, for firmly, but removable, holding said liner to said receptacle.

* * * * *